US005562015A

United States Patent [19]

Zinck

[11] Patent Number: 5,562,015

[45] Date of Patent: Oct. 8, 1996

[54] AUTOMATIC RATCHET REVERSAL DEVICE

[76] Inventor: Frederick L. Zinck, 600 S. Elmwood Ave., Glenolden, Pa. 19036

[21] Appl. No.: 490,197

[22] Filed: Jun. 14, 1995

[51] Int. Cl.[6] ..... B25B 21/00

[52] U.S. Cl. ..... 81/57.13; 81/63; 192/43.1

[58] Field of Search ..... 81/57.13, 57.29, 81/63, 63.2; 192/43.1

[56] References Cited

U.S. PATENT DOCUMENTS 1,854,513 4/1932 Hummel .
3,529,498 9/1970 Northcutt ..... 81/54
4,218,940 8/1980 Main ..... 81/63
4,529,071 7/1985 Gagnon ..... 192/43.1
4,974,475 12/1990 Lord et al. ..... 81/57.13

*Primary Examiner*—James G. Smith

[57] ABSTRACT

An automatic ratchet reversal device actuated by any reversible rotatable motor is disclosed. A rotatable force applied by a motor in one direction causes a linkage means to reciprocate once to actuate a ratchet pawl for one-direction ratcheting. Reversal of the rotatable motor causes the linkage means to reciprocate once again in the opposite direction thus acutating a ratchet pawl in the opposite direction effecting the desired reversed ratcheting.

6 Claims, 6 Drawing Sheets

AUTOMATIC RATCHET REVERSAL DEVICE

BACKGROUND OF THE INVENTION

1. Field of the Invention

This invention relates primarily to automatic ratchet reversal of tools utilizing a ratcheting device. In particular, this invention relates to an automatic ratchet reversal device used on pneumatic, electric or battery powered hand ratchets.

2. Description of the Prior Art

Conventional powered ratchets commonly used for assembly and dissassembly operations use a lever or button to reverse the ratcheting mechanism. These levers or bottons are generally located near the ratcheting device and can create clearance problems when working in restricted areas. This ratcheting device must also be manually reversed and can be accidentially reversed when not so desired. These ratchets are also relatively slow at 300 rpm maximum.

SUMMARY OF THE INVENTION

In accordance with the present invention, this ratcheting reversal device is automatically reversed when the powering motor is reversed. Such a device needs no external levers or buttons, hence no conscience effort on the part of the operator. Ratchet in the desired direction is available at all times yet needed only when a resistive load overpowers the motor. This device is also much faster than conventional ratchets having the same torque.

DESCRIPTION OF THE PREFERRED EMBODIMENT

Figure 1:
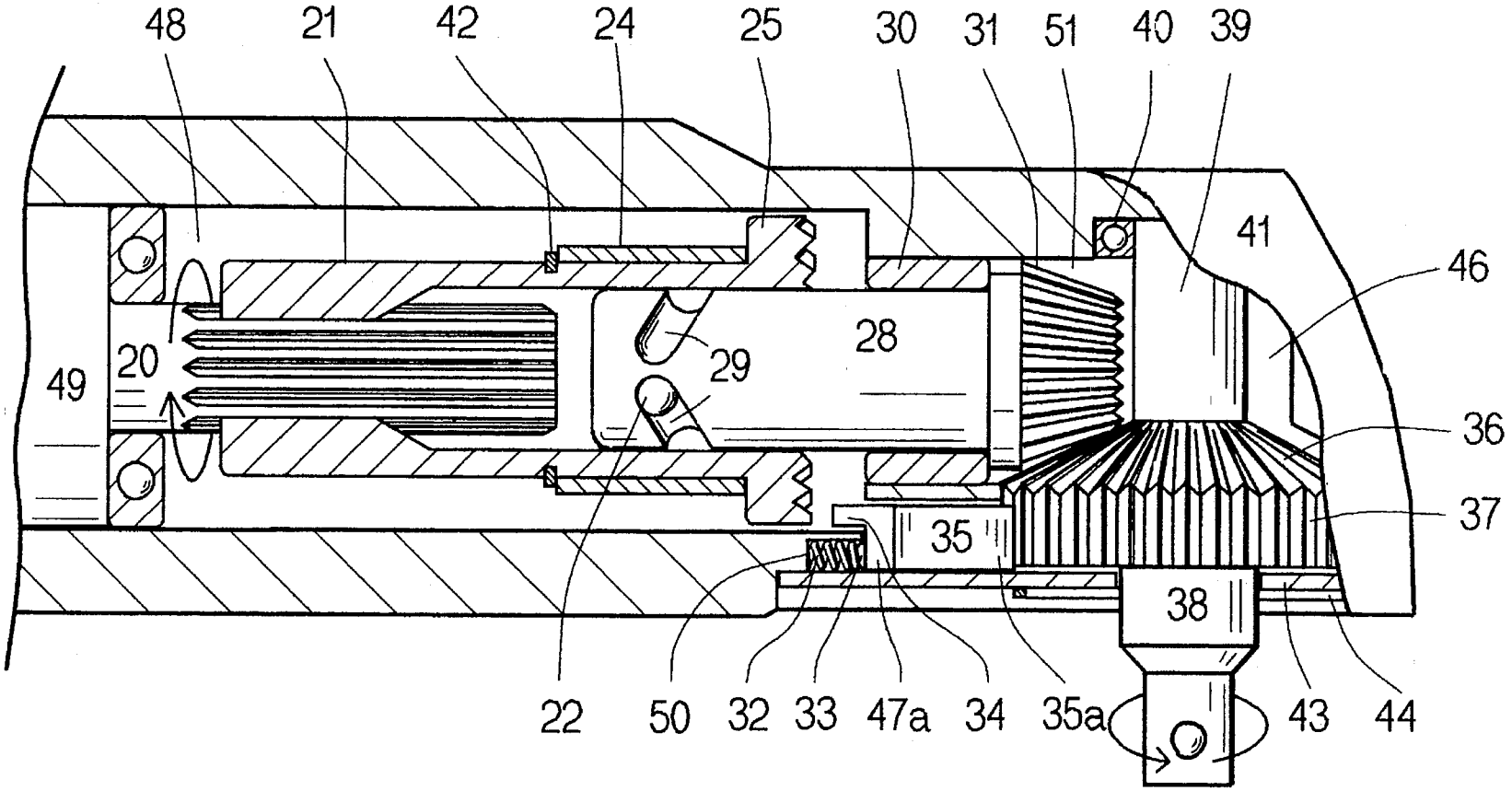
FIG. 1 is a right side elevated sectional view of the present invention in its counterclockwise or off position.
Figure 2:
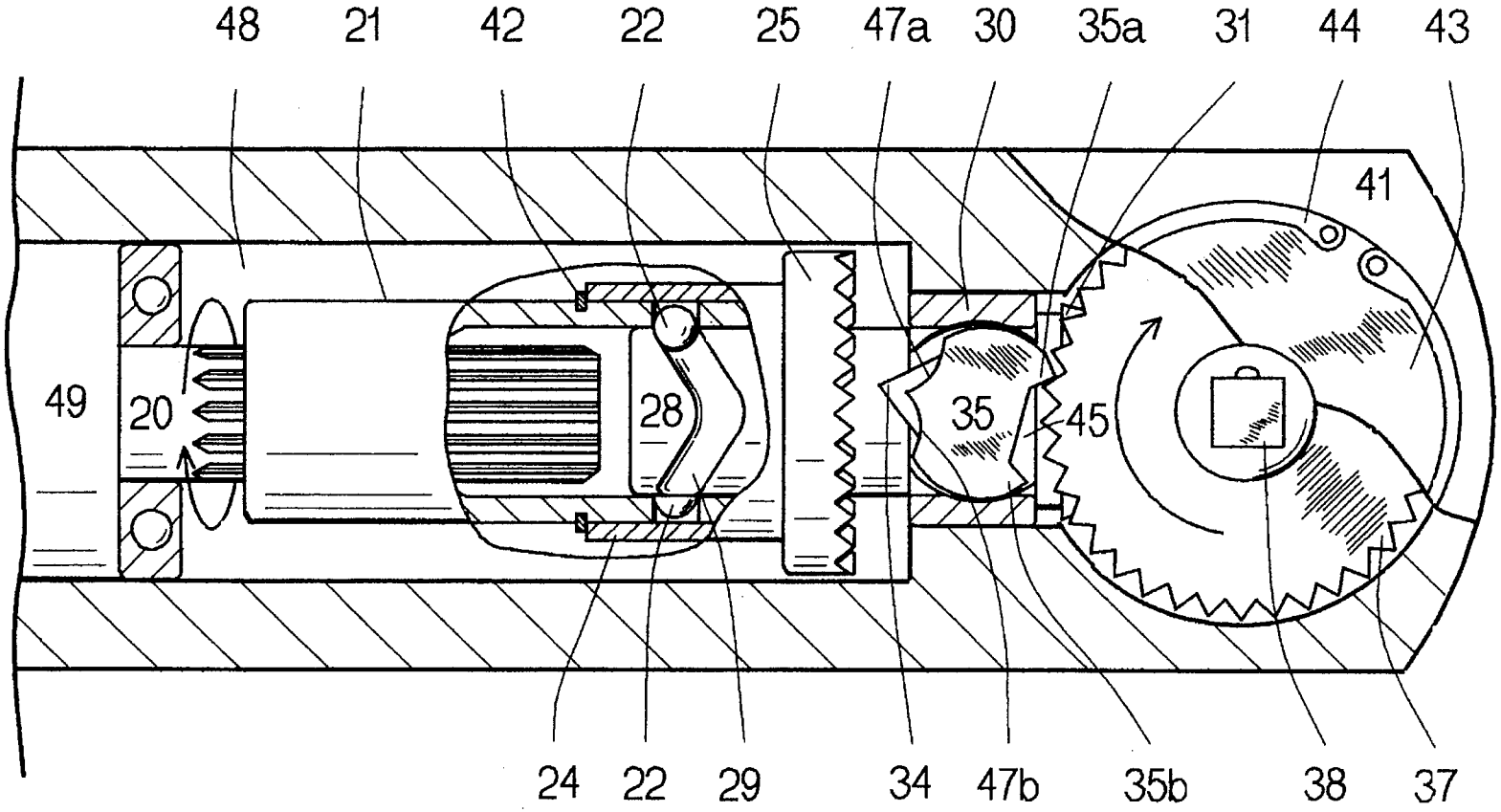
FIG. 2 is a bottom elevated sectional view of the present invention also in its counterclockwise or off position.

Referring now to FIGS. 1 and 2, the structure illustrated comprises a housing 41 having a longitudinal counterbore 48 which accepts a reversible rotatable motor 49 having an externally splined rotatable driving member 20 extending axially inward. Reversal coupling 21 having internal complimentary splines is rotatably linked and axially slidable about driving member 20. Reversal coupling 81 is counterbored longitudinally and axially slidable about driving gear shaft 28. Driving gear shaft 88 having an annular driving gear 31 disposed in perpendicular counterbore 46 is rotatable in bearing 30 secured in smaller counterbore 51 concentrically inward from counterbore 48. Pawl reverser gear 25 is located annularly on counterbored end of reversal coupling 21 and rotatable about driving gear shaft 88.

Counterbore 46 intersects counterbore 51 perpendicularly and receives driven gear 36 which is concentrically mounted on driven gear shaft 39. Driving gear 31 perpendicularly drives driven gear 36. Shaft support bearing 40 being recessed in counterbore 46 supports driven gear shaft 39 for rotation. Ratcheting gear 37 having a plurality of teeth is disposed about the periphery and adjacent to driven gear 36. A circular recess 45 parallel to counterbore 46 is provided in the housing 41 to allow communication between a generally circular ratchet pawl 35 and ratcheting gear 37. Ratchet pawl 35 has a plurality of interruptible teeth **35*a* and 35*b* meshible with ratcheting gear 37 whereby ratcheting action is dependant on the rotary position of the pawl 35, being non-meshable in mid-position. Ratchet pawl 35 has adjacent concave indentations 47*a* and 47*b* diametrically opposite teeth 35*a* and 35*b* at its periphery. Pawl lever 34 centered between and adjacent to indentations 47*a* and 49*b* extends beyond the circumference of ratchet pawl 35 and is disposed in counterbore 48. Pawl spring 32 and pawl ball 33 being recessible in aperture 50 respectively, provide tension against pawl indentation 47*b*, thus maintaining meshibility between pawl teeth 35*a* and ratcheting gear 37 for counterclockwise rotation only. Driving gear shaft 28 has recessed at its periphery opposing v-shaped ball guide cams 29 with their pointed ends aiming toward driving gear 31. Each ball guide cam receives half of one cam ball 22 and other halves of cam balls 22 are disposed in ball guide holes 23 located diametrically opposite each other in reversal coupling 21. Ball retention sleeve 24 being affixed to reversal coupling 21 by snap ring 42 retains cam bails 22. Retainer 43 maintains the assembly and provides rotational support for ratchet anvil 38. Snap ring 44 holds retainer 43** in place.

OPERATION OF THE PREFERRED EMBODIMENT

Figure 3:
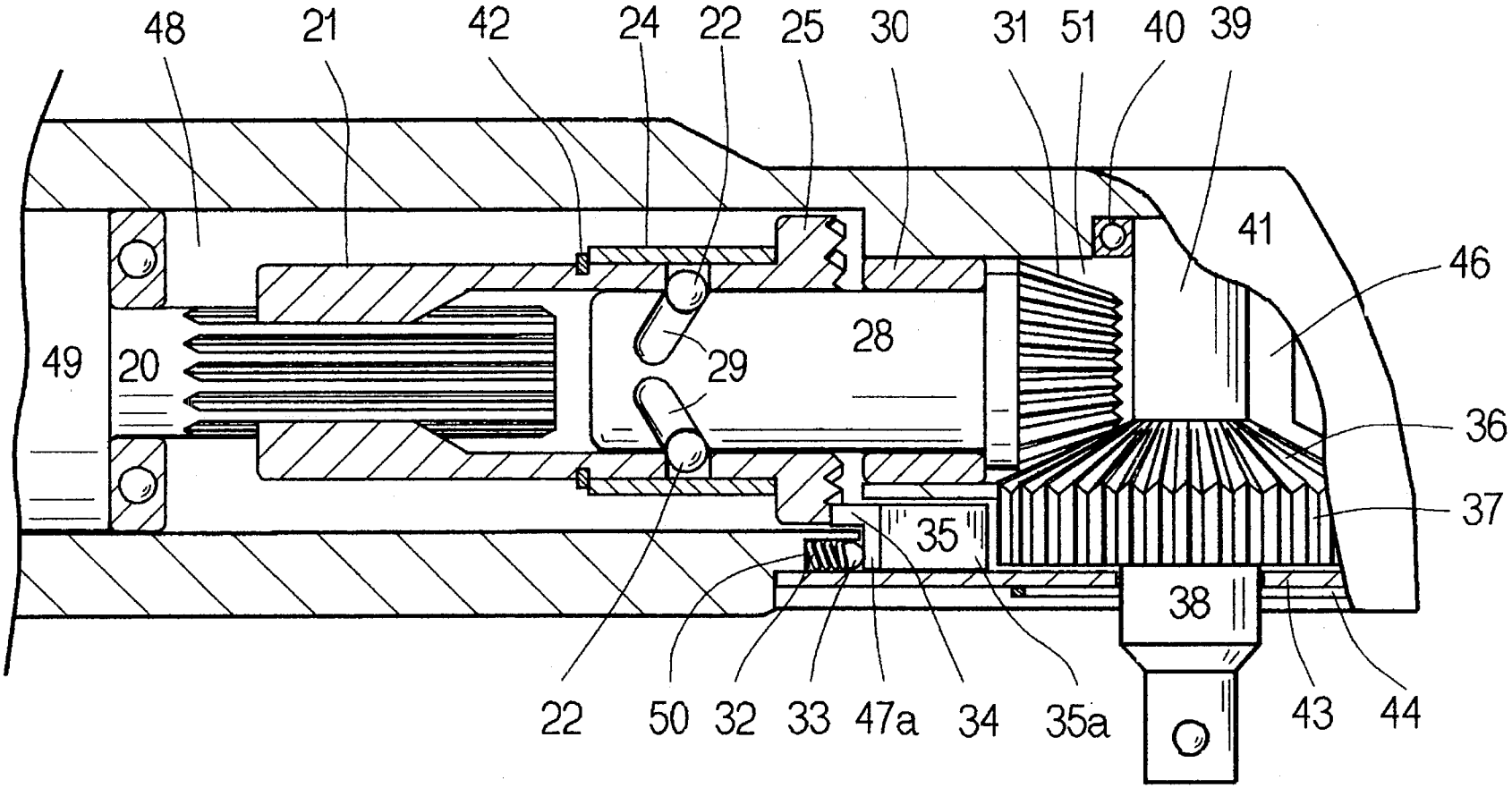
FIG. 3 is a right side elevated sectional view of the present invention midway between its off and on positions showing engagement of the reversal coupling and pawl.
Figure 4:
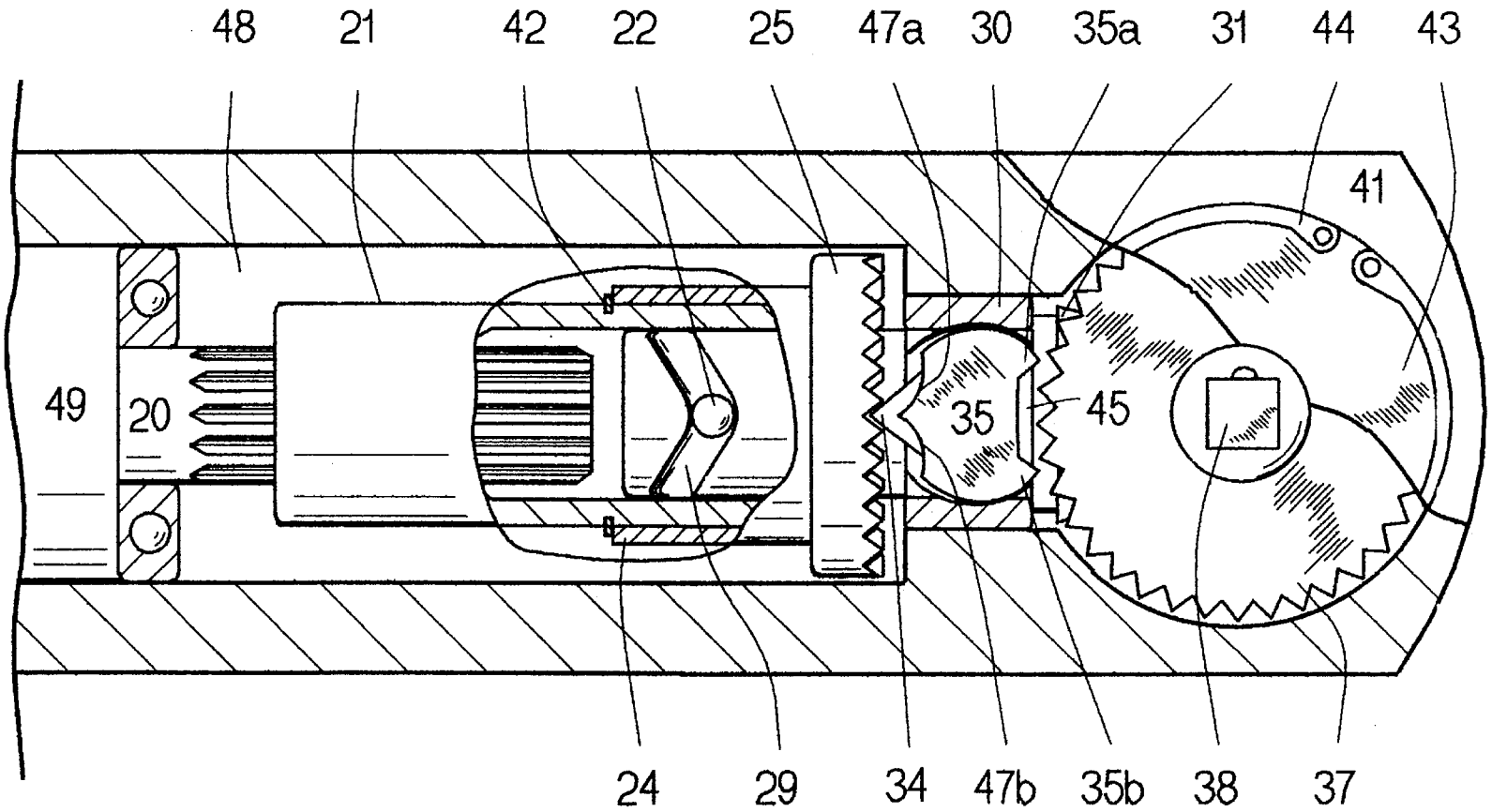
FIG. 4 is a bottom elevated sectional view of the present invention also midway between its off and on positions showing engagement of the reversal coupling and pawl.
Figure 5:
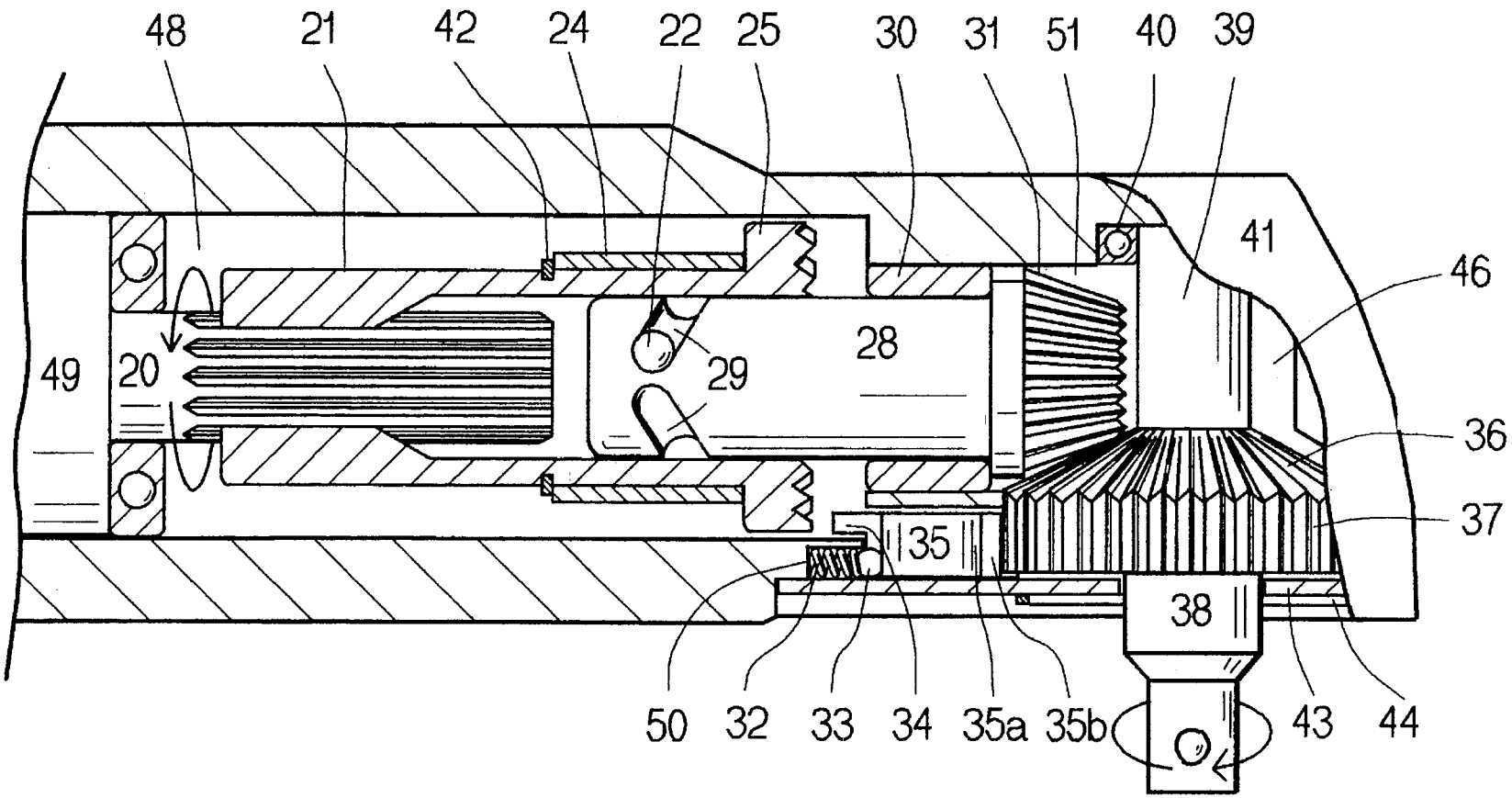
FIG. 5 is a right side elevated sectional view of the present invention in its clockwise or tightening position.
Figure 6:
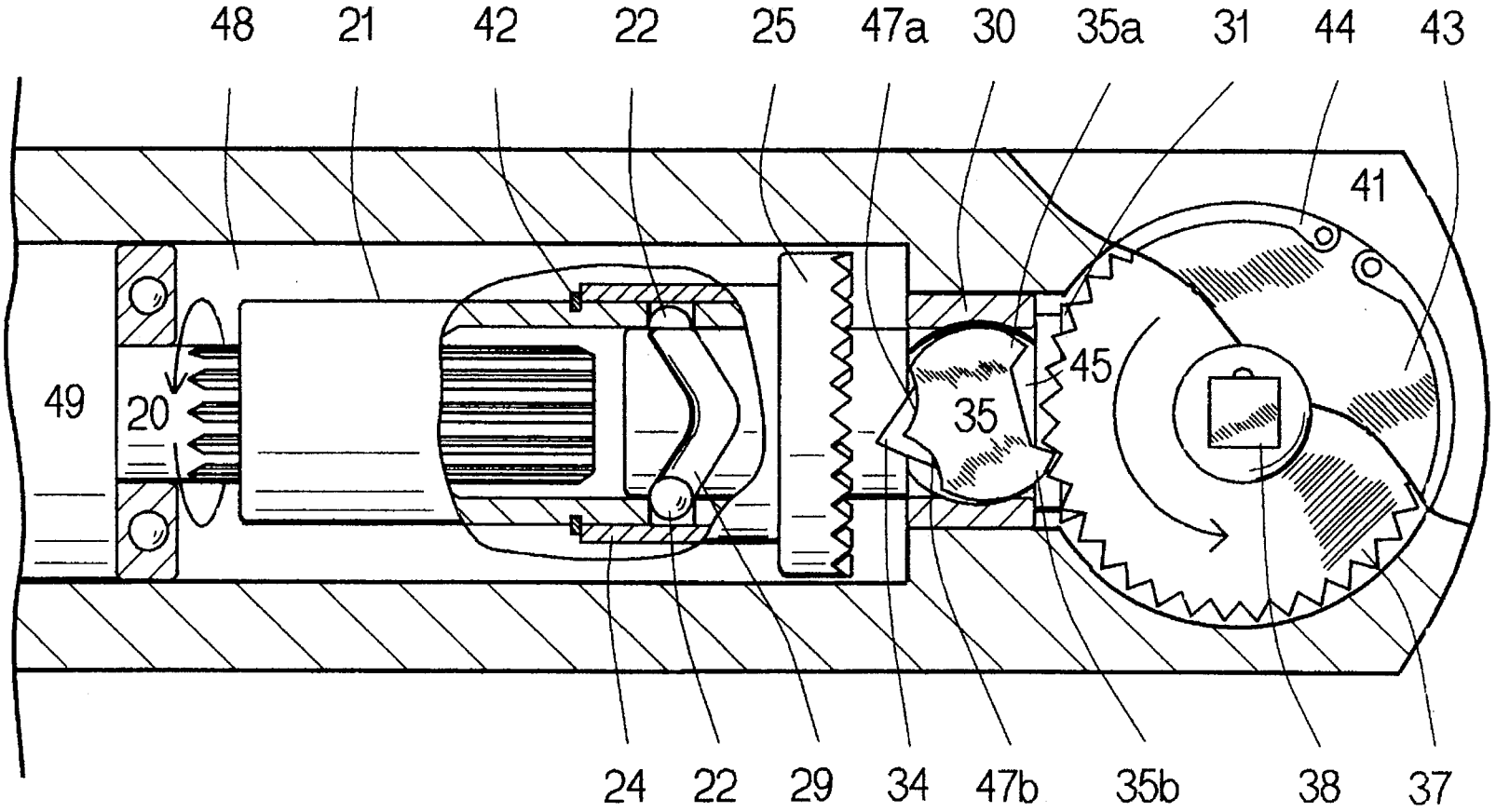
FIG. 6 is a bottom elevated sectional view of the present invention in its clockwise or tightening position. Reference to rotations are opposite from all bottom views.

Referring again to FIGS. 1 and 2, a reversible rotatable motor 49 rotating counterclockwise(viewed from the left) concentrically rotates driving member 20 which directly drives reversal coupling 21. Reversal coupling 21 forces rotation of driving gear shaft 28 and driving gear 31. Driving gear 31 forces rotation of driven gear shaft 39 by meshing with driven gear 36 thus causing ratchet anvil 38 to drive various attachments or devices in a counterclockwise or off direction(opposite from FIG. 2). When a resistive load overpowers the motor 49 a ratcheting effect is desired. Pawl spring 32 and pawl ball 33, respectively recessible in aperture 50, force tension against pawl indentation **47*b* causing pawl teeth 35*a* to mesh with ratcheting gear 37 allowing for counterclockwise rotation only(as viewed from the top). Operator can now ratchet(osillate) to overcome the resistive load. Reversal of air motor 49 causes clockwise rotation of driving member 20 (as viewed from the left) effecting direct rotation of reversal coupling 21. Cam balls 22 secured in ball guide holes 23 by ball retention sleeve 24 rotate directly with reversal coupling 21. As rotation continues cam balls 22 follow the path of ball guide cams 29 thus forcing reversal coupling 21 to slide toward ratchet pawl 35. Now referring to FIGS. 3 and 4, pawl reverser gear 25 engages pawl lever 34 forcing ratchet pawl 35 to rotate clockwise (as viewed from the top). Pawl ball 33 is forced out of pawl indentation 47*b* and recesses into aperture 50. As viewed pawl teeth 35*a* and 35*b* are non-meshible with ratcheting gear 37. Now referring to FIGS. 5 and 6, pawl ball 33 is tensioned against pawl indention 47*a* forcing pawl teeth 35*b* to engage ratcheting gear 37 allowing for clockwise rotation only of ratchet anvil 38. It should be noted that pawl reverser gear 25 only has to engage pawl lever 34 long enough to allow pawl ball 33 to begin its tension against either indentation 47***a* or 47*b*. Further engagement is not required since tension from the pawl ball 33 forces further rotation of pawl 35 for its engagement with ratcheting gear

What I claim is:

1. An automatic ratchet reversal device comprising:

a housing, a rotatable shaft axially aligned in said housing, reversible motor means for rotating said shaft, a linkage means directly rotatable with and axially slidable about said rotatable shaft, said linkage means axially slidable and rotatable about a driven means, said linkage means and said driven means rotatably linked by an actuation means whereby reversal of said rotatable shaft causes said linkage means to reciprocate to and from said driven means once during initial reversal, forced rotation of said driven means after reciprocation of said linkage means.

2. The combination in claim 1 wherein said linkage means has annular engageble protrusions nearest said driven means.

3. The combination in claim 2 and having pawl means recessed in said housing levered for temporary engagement with said protrusions when said linkage means is reciprocated toward said driven means, not engageble when said linkage means is reciprocated from said driven means.

4. The combination in claim 3 wherein said pawl means has an interrupted periphery diametrically opposite its levered portion whereby oppositely directed teeth are engageble with a ratcheting means, operative engagement of said pawl means and said ratcheting means maintained by continuous tension means recessed in said housing.

5. The combination in claim 1 in which said driven means has transmission means perpendicularly engageble with driving means for driving a resistive load.

6. The combination of claim 4 wherein said driven means has transmission means perpendicularly engageable with a driving means for driving a resistive load.

* * * * *